US005687425A

United States Patent [19]

Blosser

[11] Patent Number: 5,687,425

[45] Date of Patent: Nov. 18, 1997

[54] CAP STRAP CUSHION AND METHOD OF USE THEREOF

[76] Inventor: Stephen James Blosser, P.O. Box 141, New Baltimore, N.Y. 12124

[21] Appl. No.: 658,086

[22] Filed: Jun. 4, 1996

[51] Int. Cl.[6] ..... A42C 5/00

[52] U.S. Cl. ..... 2/209.13; 2/181.4; 2/195.2

[58] Field of Search ..... 2/181, 181.2, 181.4, 2/195.2, 209.13; 40/329

[56] References Cited

U.S. PATENT DOCUMENTS

| | | | |
|---|---|---|---|
| Re. 33,430 | 11/1990 | Nunnery et al. | 2/181 |
| 676,293 | 6/1901 | Wright . | |
| 1,808,966 | 6/1931 | Morgan . | |
| 5,003,640 | 4/1991 | Pizzacar | 2/199 |
| 5,161,259 | 11/1992 | Shorts | 2/199 |
| 5,287,559 | 2/1994 | Christiansen et al. | 2/181 |
| 5,315,714 | 5/1994 | Peters et al. | 2/209.13 |
| 5,428,844 | 7/1995 | Dougherty | 2/209.13 |
| 5,442,817 | 8/1995 | Miner | 2/195.1 |

*Primary Examiner*—Diana Biefeld
*Attorney, Agent, or Firm*—Heslin & Rothenberg, P.C.

[57] ABSTRACT

A cap strap cushion is attachable to one or more adjustable straps of a baseball-style cap. The cushion includes a tubular member having a first open end and a second open end, each of the open ends defining an inseparable edge. An interior channel extends the length of the tubular member, from the first open end to the second open end. The first and second open ends each are configured so that the adjustable straps can be inserted into and through the interior channel. The tubular member is sized such that when the adjustable straps are inserted into and through the channel, the tubular member fits thereon. The tubular member may be stitched from the edge of the first open end to the edge of the second open end. A soft, pliable material, such as fleece, may be employed in the subject invention. The cap strap cushion may accommodate a plurality of engaged adjustable straps having differing lengths. A method of using the cap strap cushion of the present invention is also disclosed.

9 Claims, 1 Drawing Sheet

CAP STRAP CUSHION AND METHOD OF USE THEREOF

BACKGROUND

1. Technical Field

The present invention generally relates to headgear, such as baseball-style caps. More particularly, the present invention relates to cushions or comforters which may be easily attached to and removed from the adjustable straps of a baseball-style cap.

2. Background Information

Headgear, such as baseball-style caps and hats, are worn by people for many reasons, e.g., protection from the elements, fashion concerns, advertising and group association. Typically, baseball-style caps include adjustable straps, located at the rear of the cap, so that the cap can be adjusted to fit many different sized heads. Such caps are often referred to as "one-size-fits-all" headgear. However, not only are the adjustable straps unsightly, they are also uncomfortable to the cap wearer. While various devices for attachment to the adjustable straps of a baseball-style cap are known to exist, especially for advertisement purposes, none of these devices are simply constructed for easy attachment and removal. For example, most of the existing devices include cumbersome and complex means for attaching the devices to the adjustable straps of a baseball-style cap, such as hook/loop fasteners and mounting bars. Moreover, it appears that none of the existing devices provide satisfactory comfort for the cap wearer. Finally, none of the devices are configured for adequately accommodating a plurality of engaged adjustable straps having differing lengths.

Thus, a need exists for a cushion or comforter which may be easily attached to and removed from the adjustable straps of a baseball-style cap, and also adapted to adequately accommodate a plurality of engaged adjustable straps having differing lengths. The structure of the present invention contains a solution to the aforementioned problems.

SUMMARY OF THE INVENTION

Briefly, the present invention satisfies this need and overcomes the shortcomings of the prior art through the provision of a cap strap cushion, attachable to one or more adjustable straps of a baseball-style cap, which includes a tubular member having a first open end and a second open end, with each of the open ends defining an inseparable edge. A channel or passage extends from the first open end to the second open end. The first and second open ends are each configured so that the adjustable straps can be inserted into and through the interior channel. The tubular member is configured such that when the adjustable straps are inserted into and through the channel, the tubular member fits thereon, providing the cap wearer with a comfortable cushioning element.

It is therefore a primary object of the present invention to provide a cap strap cushion which increases comfort associated with wearing baseball-style caps or other headgear.

It is another object of the present invention to provide a cap strap cushion which may be easily attached to and removed from the adjustable straps of a baseball-style cap.

It is still another object of the present invention to provide a simply constructed cap strap cushion which facilitates ease of use and wearer comfort.

It is yet another object of the present invention to provide a cap strap cushion which can accommodate a plurality of engaged adjustable straps having differing lengths.

BRIEF DESCRIPTION OF THE DRAWINGS

The subject matter which is regarded as the present invention is particularly pointed out and distinctly claimed in the concluding portion of the specification. The invention, however, both as to organization and method of practice, together with the further objects and advantages thereof, may be best understood by reference to the following detailed description, taken in conjunction with the accompanying drawings, in which:

DESCRIPTION

Figure 1:
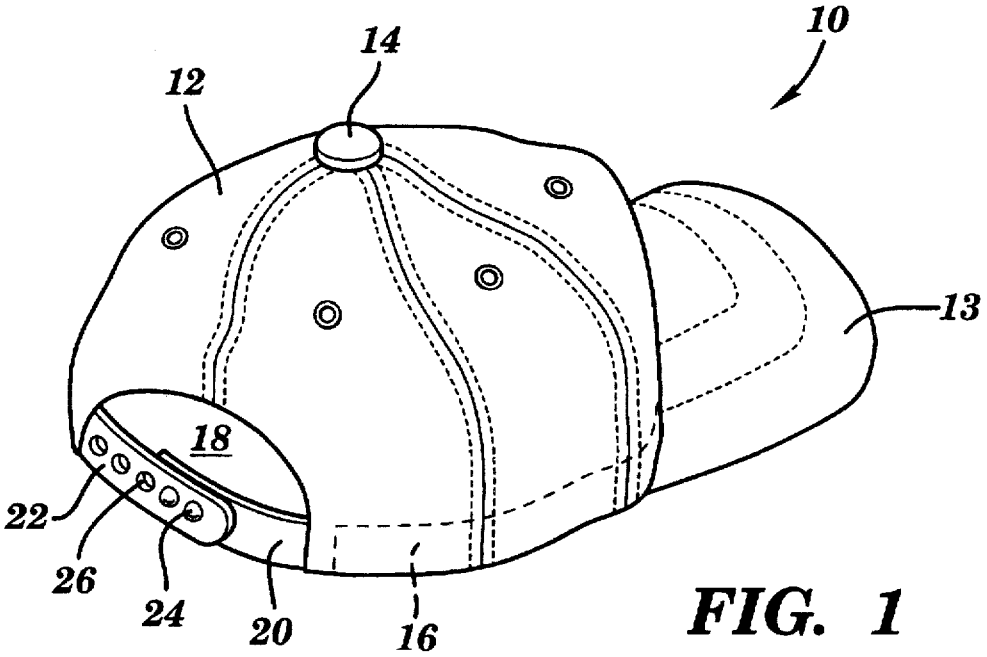
FIG. 1 is a rear perspective view of an adjustable baseball-style cap having two adjustable cap straps removably engaged together.
Figure 2:
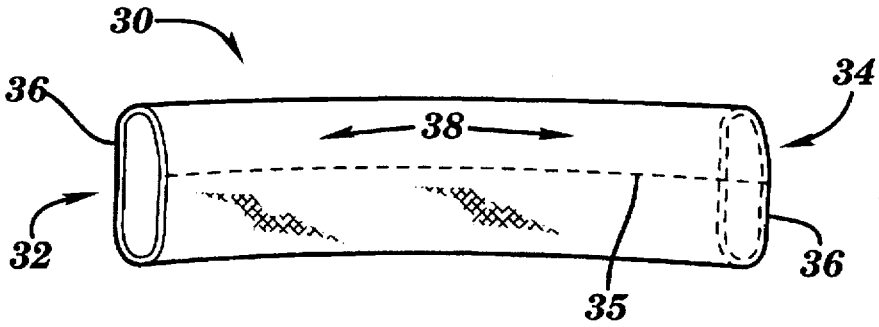
FIG. 2 is a pictorial view of a cap strap cushion constructed in accordance with the principles of the present invention.
Figure 3:
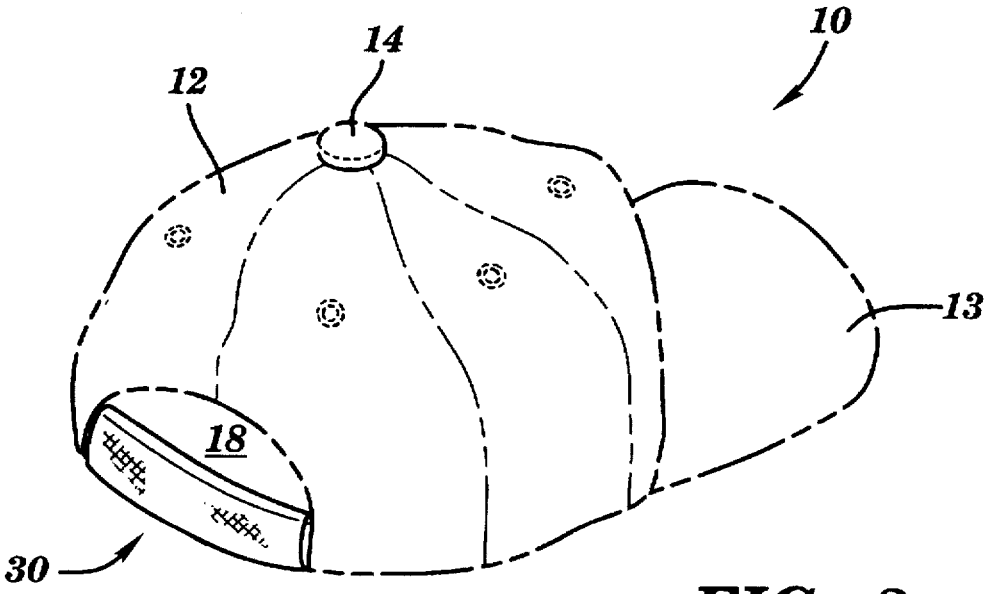
FIG. 3 is a perspective view showing the baseball-style cap shown in FIG. 1 in phantom, with the cap strap cushion illustrated in FIG. 2 attached to the adjustable straps of the cap.

It will be readily apparent that the components and features of the present invention, as generally described and illustrated in the figures, could be arranged and designed in a wide variety of different configurations. Thus, the following detailed description of the presently preferred embodiments of the cap strap cushion of the present invention, as represented in FIGS. 1–3, is not intended to limit the scope of the invention, as claimed, but is merely representative of the presently preferred embodiments of the invention. The presently preferred embodiments of the invention will be best understood by reference to the drawings, where like parts are designated with like numerals.

In reference to the drawings, and more particularly to FIG. 1, there is shown a baseball-style cap 10, which generally includes a hemispherically formed head portion 12, constructed from a pliable fabric, such as cotton or wool. Disposed at the apex of head portion 12 is a button 14, where the stitching for the cap typically converges. A visor 13 extends forwardly away from head portion 12. At the lower periphery of head portion 12, disposed on the inside of cap 10, a band 16 stretches substantially therearound. A semi-circular opening 18 is formed at the rear of head portion 12. During usage of cap 10, opening 18 partially exposes the rear of a person's head.

Extending from the inside of cap 10 and forming the bottom of semi-circular opening 18 is a pair of adjustable straps, i.e., a first adjustable strap 20 and a second adjustable strap 22, both employed for adjustably fitting cap 10 to a number of different head sizes. Typically, adjustable straps are formed from a plastic material. As such, first adjustable strap 20 includes a plurality of male elements, i.e., knobs 24, and second adjustable strap 22 includes a plurality of female elements, i.e., apertures 26. By removably fitting one or more knobs 24 into an equal number of apertures 26, cap 10 can be fitted to a number of different head sizes. It should be noted that the subject invention is not in any way limited for use with adjustable plastic straps, but is intended to be employed with any type of adjustable straps used for adjusting cap size, e.g., leather straps having a buckle locking apparatus.

FIG. 2 depicts the cap strap cushion or comforter of the present invention, i.e., a tubular member 30 which may be easily attached to and removed from adjustable straps 20, 22. Tubular member 30 may have a first open end 32 and a second open end 34, with each of the open ends defining a continuous and inseparable edge 36. The term "inseparable," as used throughout this specification is intended to mean that edge 36 is configured such that it is not intended to be manually separated by hand. It should be understood, however, that the term inseparable does not mean that edge 36 cannot be ripped or torn apart. Therefore, each edge 36 is preferably sewn to form inseparable edge 36, and as such, tubular member 30 may include a seam 35 extending the length thereof.

An interior passage or channel 38 may extend from first open end 32 to second open end 34. Both first open end 32 and second open end 34 are configured so that the ends of both adjustable straps 20, 22 can be inserted into interior channel 38 of tubular member 30. Tubular member 30 is sized such that when adjustable straps 20, 22 are inserted into and through said interior channel 38, and then engaged together, tubular member 30 may extend the entire length of the engaged straps 20, 22. Tubular member 30 should have sufficient length to accommodate the length adjustability of straps 20, 22. Therefore, tubular member 30 should be sufficiently elongated to envelop or cover adjustable straps 20, 22 which are engaged to one another in the widest position, i.e., to accommodate the largest head possible. Moreover, tubular member 30 should be configured to adequately accommodate a plurality of engaged adjustable straps having differing lengths. However, tubular member 30 may be offered in various different sizes, e.g., small, medium and large, so that a precise fitting can be achieved for a particular setting of engaged adjustable straps 20, 22. Also, the user has the option of selecting a lengthy tubular member 30, which can then be cut to a particular length.

Tubular member 30 should be constructed from a material which facilitates comfort and ease of use. More specifically, the material selected for tubular member 30 should be soft, pliable and deformable. Pliability and deformability is significant because such characteristics facilitate ease of attaching and removing tubular member 30 from adjustable straps 20, 22. In addition, pliability and deformability facilitates the capacity for tubular member 30 to accommodate engaged adjustable straps of differing lengths. While any material having such characteristics may be employed for tubular member 30, a synthetic fleece, such as acrylic fleece, is preferred. Acrylic fleece facilitates comfort, is breathable (and promotes wicking away of perspiration), dries easily, and is stretchable, highly pliable and deformable. Also, acrylic fleece holds its color well, which is important for aesthetic reasons. Other suitable materials include, for example, polar print and other pile products.

As illustrated in FIG. 3, tubular member 30 may be removably attached to adjustable straps 20, 22 by first disengaging adjustable straps 20, 22 from one another. Next, the end of first adjustable strap 20 (or second adjustable strap 22) may be inserted into either open end 32 (or open end 34) of tubular member 30. Because tubular member 30 is constructed from a soft, pliable and deformable material, it can then be "bunched up" for ease of attachment. After completely "bunching up" tubular member 30 on first adjustable strap 20, the adjustable straps 20, 22 can be sizably adjusted and fastened to one another to fit a particular head. The attached tubular member 30 may then be properly positioned for covering and enveloping both adjustable straps 20, 22.

Alternatively, after both first and second adjustable straps 20, 22 are inserted into interior channel 38 of tubular member 30, the adjustable straps 20, 22 can be sizably adjusted and fastened to one another to fit a particular head. By "feeling" the engagement of knobs 24 and holes 26 together, straps 20, 22 can be fastened. The attached tubular member 30 may then be further positioned for covering and enveloping both adjustable straps 20, 22.

In removing tubular member 30 from cap 10, the user may disengage first adjustable strap 20 from second adjustable strap 22. As in installation of tubular member 30, the user may "bunch up" pliable member 30 for ease of removal. Therefore, adjustable straps 20, 22 may be pulled so that tubular member 30 is no longer attached to the straps.

A significant advantage of the present invention is the lack of need for any complex attachment means for attaching the comforter to the adjustable straps of a baseball-style cap, such as hook/loop fasteners and mounting bars. By simply sliding tubular member 30 over adjustable straps 20, 22, the user has a comfortable cushion for enhancing the cap wearing experience. The tubular member itself acts as the attachment means.

In addition, the cap strap cushion of the present invention may include advertising indicia thereon, or for aesthetic reasons, include artistry.

While several aspects of the present invention have been described and depicted herein, alternative aspects may be effected by those skilled in the art to accomplish the same objectives. For example, while the subject invention has been described in conjunction with plastic adjustable straps most commonly associated with baseball-style caps, the invention may be employed with any kind of cap or hat having adjustable straps. Accordingly, it is intended by the appended claims to cover all such alternative aspects as fall within the true spirit and scope of the invention.

What is claimed:

1. A cap strap cushion attachable to one or more adjustable straps of a baseball-style cap, comprising:

a pliable tubular member having a first open end and a second open end, each of said open ends defining an inseparable edge;

an interior channel extending from said first open end to said second open end;

said first open end and said second open end each being configured so that either of said one or more adjustable straps can be inserted into and through said interior channel;

said pliable tubular member being sized to receive said one or more adjustable straps therein; and wherein said pliable tubular member comprises a synthetic fleece.

2. The cap strap cushion of claim 1, wherein said pliable tubular member is stitched from the edge of said first open end to the edge of said second open end.

3. The cap strap cushion of claim 1, wherein said synthetic fleece is an acrylic fleece.

4. The cap strap cushion of claim 1, wherein said pliable tubular member is adapted to accommodate a plurality of engaged adjustable straps having differing lengths.

5. In a baseball-style cap, the cap having a pair of adjustable straps being engageable to each other, said pair of straps being engageable into a plurality of differing positions, a cap strap cushion, comprising:

a deformable tubular member having a first open end and a second open end, each of said open ends defining an inseparable edge;

an interior passage extending from said first open end to said second open end;

said first open end and said second open end being configured for receiving said pair of adjustable straps therein;

wherein said tubular member is adapted to be fit on said pair of engageable adjustable straps; and wherein said deformable tubular member comprises acrylic fleece.

6. The cap strap cushion of claim 5, wherein said deformable tubular member is stitched from the edge of said first open end to the edge of said second open end.

7. A method of using a cap strap cushion in conjunction with a pair of adjustable straps of a baseball-style cap, said method comprising:

(a) grasping a soft and pliable tubular member made from synthetic fleece, said member having first and second open ends and an interior channel extending from said first open end to said second open end;

(b) inserting a first of said pair of adjustable straps into said first open end and through said interior channel;

(c) fastening said pair of adjustable straps together; and (d) positioning said tubular member on said fastened pair of adjustable straps so as to cover said fastened pair of adjustable straps.

8. The method of using a cap strap cushion of claim 7, wherein said inserting step (b) includes bunching up said soft and pliable tubular member so as to facilitate attachment to said pair of adjustable straps.

9. The method of using a cap strap cushion of claim 7, further comprising the step of removing said soft and pliable tubular member from said pair of adjustable straps.

* * * * *